United States Patent [19]

Marx et al.

[11] Patent Number: 4,628,571

[45] Date of Patent: Dec. 16, 1986

[54] METHOD FOR PRODUCTION OF A NON-WOVEN FABRIC

[75] Inventors: Karl Marx, Radebeul; Peter Offermann, Dresden; Ralf-Dieter Reumann, Dresden; Matthias Mägel, Dresden; Bertram Frenzel; Dietmar Grenzendörfer, both of Karl Marx Stadt, all of German Democratic Rep.

[73] Assignee: VEB Kombinat Textima, Karl Marx Stadt, German Democratic Rep.

[21] Appl. No.: 729,443

[22] Filed: May 1, 1985

Related U.S. Application Data

[62] Division of Ser. No. 570,131, Jan. 12, 1984, Pat. No. 4,589,169.

[30] Foreign Application Priority Data

Mar. 25, 1983 [DD] German Democratic Rep. ..... 2491717

Mar. 25, 1983 [DD] German Democratic Rep. ..... 2491725

[51] Int. Cl.[4] ..... D01G 25/00

[52] U.S. Cl. ..... 19/304; 19/161.1; 19/163; 19/299

[58] Field of Search ..... 19/304, 161.1, 163, 19/296; 299, 301, 302; 28/102

[56] References Cited

U.S. PATENT DOCUMENTS

| | | | |
|---|---|---|---|
| 3,134,145 | 5/1964 | Miller | 19/299 X |
| 3,364,538 | 1/1968 | Murphy | 19/304 X |
| 3,760,458 | 9/1973 | Pitt | 19/299 X |
| 3,879,820 | 4/1975 | Grieves et al. | 19/163 X |
| 3,934,312 | 1/1976 | Trout | 19/299 X |
| 4,280,253 | 7/1981 | Holt | 19/161.1 X |

*Primary Examiner*—Louis K. Rimrodt
*Assistant Examiner*—Judy Olds
*Attorney, Agent, or Firm*—Jordan and Hamburg

[57] ABSTRACT

A non-woven fabric is produced by the transportation of a fiber flow at an angle which is less than 90° to the transport direction of the non-woven fabric to be manufactured, with the feed rate of the fiber flow being controlled, the fibers which are to form a fiber layer being placed next to one another, and with the formed fiber layer being simultaneously, and in the lateral border areas of the fiber layers, being consecutively, combined with the preceding fiber layer, reinforcing the produced non-woven fabric. The angle of the fiber flow to the transport direction of the non-woven fabric to be manufactured is set between 0° and 89°. The controlling of the fiber flow comprises monitoring of the quantity feed rate and/or dissociation of the fiber flow and/or fiber mixing, immediately prior to the formation of a fiber layer. In order to combine the formed fiber layer with the preceding fiber layer, this is placed adjacent to the formed fiber layer, or placed on at least one formed fiber layer.

13 Claims, 8 Drawing Figures

METHOD FOR PRODUCTION OF A NON-WOVEN FABRIC

This is a division, of application Ser. No. 570,131, filed Jan. 12, 1984 now U.S. Pat. No. 4,589,169.

BACKGROUND OF THE INVENTION AND PRIOR ART STATEMENT

The invention relates to a method and an apparatus for production of a non-woven fabric, preferably for textile sheets.

It is known that non-woven fabrics can be produced mechanically and/or aerodynamically and/or hydrodynamically, with the fiber material being dispersed mechanically and/or aerodynamically into individual fibers, with a fiber nap or non-woven fabric being simultaneously formed, deposited, and transported over the entire working width. Most technical solutions disclose carding power units for the mechanical non-woven fabric formation over the entire working width. The processing of the fiber naps into non-woven fabric is accomplished by layering or paneling. In accordance with the preferred fiber direction of the fiber nap or non-woven fabric, the result can be longitudinal fleece, lateral fleece, cross fleece and irregular fleece (Boettcher, P. et al.: Vliesstoffe, VEB Fachbuchverlag Leipzig 1976).

It is furthermore known that a non-woven fabric can be mechanically produced by means of a meander-shaped fiber track, located perpendicular to the the transport direction of the non-woven fabric. According to DE-OS No. 1 926 951 the fiber track, and according to DE-OS No. 2 846 517 a fiber hank, are moved translatorily back and forth by an air stream over the respective working width, thus reaching the essentially parallel reaming position.

Poor mass uniformity over the width and length of the fleece, a lower degree of variability of the fiber orientation in the individual fiber layers of the fleece and across the fleece width, insufficient texture variability, as well as few pattern possibilities, are common disadvantages connected with these methods and apparatus. Even if the meander-shaped fleece formation from a fiber track and the loop-shaped fiber hank depot have the advantage of width variability, they also display the obvious disadvantages of periodic mass fluctuations depending on the fiber track or the fiber hank depot, with related bandiness, irregularities in the inversion or border areas, and low variability of the fiber orientation and the non-woven fabric texture.

SUMMARY OF THE INVENTION

It is an object of the invention to provide a method and an apparatus for the production of non-woven fabrics, preferably for textile sheets, with improved functional value and low production costs.

It is another object of the invention to provide a method and an apparatus for the formation of a non-woven fabric with variable working width, extensive structure variability as regards thickness, surface, type of fiber, fiber arrangement and color, as well as high mass uniformity, with simple technical expenditures.

These and other objects and advantages of the present invention will become evident from the description which follows.

The objects are accomplished in the invention in that the method for the production of a non-woven fabric provides for the transportation of a fiber flow at an angle which is less than 90° to the transport direction of the non-woven fabric to be manufactured, with the feed rate of the fiber flow being controlled, the fibers which are to form a fiber layer being placed next to one another, and with the formed fiber layer including lateral border areas of the fiber layers, being combined with the preceding fiber layer, reinforcing the produced non-woven fabric. The angle of the fiber flow to the transport direction of the non-woven fabric to be manufactured is set between 0° and 89°. The controlling of the fiber flow comprises monitoring of the quantity feed rate and/or dissociation of the fiber flow and/or fiber mixing, immediately prior to the formation of a fiber layer. In order to combine the formed fiber layer with the preceding fiber layer, this is placed adjacent to the formed fiber layer, or placed on at least one formed fiber layer. The fiber flow is formed of fibers, adhesively connected to one another, or of air-carried fibers, or of fibers carried by a liquid medium. Furthermore, the fiber flow is formed or irregular fibers or directional fibers. The fiber flow can also be formed of several partial fiber flows, located next to one another and/or above one another, having different fiber orientation and/or fiber thickness and/or fiber length and/or fiber type and/or color.

In an apparatus for the execution of the method for the production of a non-woven fabric, one or more fiber feed rate control devices, each connected to a traverse drive unit, are arranged to one or more fiber flow transport devices, below an angle of 90° to the transport direction of the non-woven fabric to be manufactured, and assigned to an already known non-woven fabric transport device. The fiber feed rate control device contains a rotation unit. The fiber feed rate control device is arranged at the beginning or above the non-woven fabric transport device. The traverse drive is formed as a pivot drive. In order to disperse the fiber flow consisting of fibers, adhesively connected to one another, the fiber feed rate control arrangement contains a dispersing roll. The fiber feed rate control device and the traverse drive unit have variable speed motors for the required adjustment of the fiber flow feed rate to the delivery speed of the non-woven fabric, depending on the surface measurement of the non-woven fabric to be produced and the reinforcement speeds. The traverse drive unit has working width position stops.

The functional value of the non-woven fabric or the textile sheet produced by reinforcement, as well as their structure and pattern characteristics, are considerably improved and enlarged by the method of the invention. Most advantageous is, on the one hand, the higher mass uniformity, which can be regulated by the fiber feed rate control, over the width and length of the non-woven fabric, with the entire width of the non-woven fabric, including the border areas, being used for the sheet formation with only minimal material losses, and, on the other hand, the intentional mass fluctuations for structural effects. The new non-woven fabric and the higher functional value can be achieved with simple technical means, resulting in the essential prerequisites for the economical use of non-woven materials in new areas of use, as well as economical, more advantageous use in typical fleece material assortments.

The invention accordingly consists in the method and apparatus for production of a non-woven fabric as described supra, and as will appear infra from the detailed description of the drawings and preferred embodiments, and as elucidated in the appended claims.

BRIEF DESCRIPTION OF THE DRAWINGS

The invention will be explained in detail by means of elements and members as shown in the drawings.

The drawings show the following.

DETAILED DESCRIPTION OF THE PREFERRED EMBODIMENTS

Figure 1:
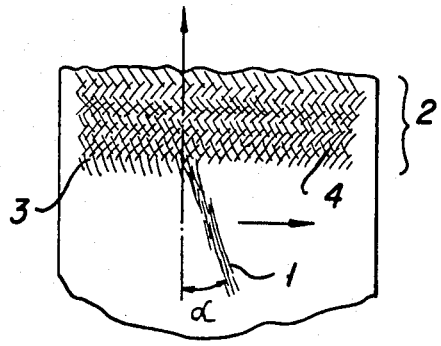
FIG. 1 shows the production of a non-woven fabric from a fiber flow of directional fibers at an angle of $0° < \alpha < 90°$ to the non-woven material transport direction.
Figure 2:
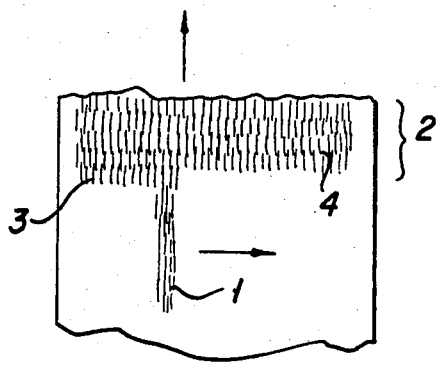
FIG. 2 shows the production of a non-woven fabric from a fiber flow of directional fibers at an angle of 0° to the non-woven fabric transport direction.
Figure 3:
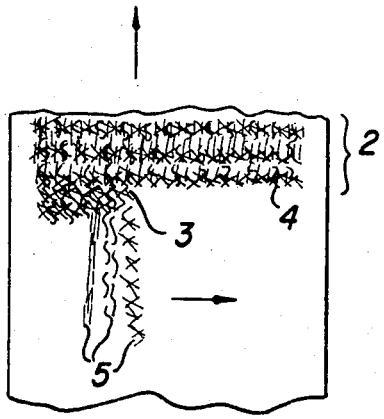
FIG. 3 shows the production of a non-woven fabric from a partial fiber flow of various fiber types and orientation; at an angle of 0° to the non-woven fabric transport direction

Referring now to the drawings, the fiber flow 1 is transported at an angle which, according to FIG. 1, is smaller than 90°, and in the most simple case, according to FIG. 2, is 0° to the transport direction of the non-woven fabric 2 to be manufactured, and the feed rate of the fiber flow 1 is controlled so that the dispersed fibers are continuously placed next to one another approximately across the width of the fiber flow 1 for the formation of a fiber layer 3 over the desired working width. By continuously controlling the feed rate and placing the fibers next to one another, the fibers are layered over the fiber flow width. The formed fiber layer 3 is simultaneously combined, and in the lateral border areas of the fiber layers, consecutively combined, with the preceding fiber layer 4. The thus produced non-woven fabric 2, which has in principle been created from more or less overlapping, i.e., according to FIG. 1, with the fiber layers 3 being placed on top of one another, and according to FIG. 2, with the fiber layers being placed next to one another, is transported on for the purpose of reinforcement by arbitrary non-woven fabric methods. FIG. 1 furthermore illustrates that the angle changes with each fiber flow modulation over the working width, symmetrically to the non-woven fabric transportation, resulting in a cross-wise layering of the fibers of subsequent fiber layers in the non-woven fabric 2. In FIG. 3, several partial fiber flows 5, which are partly formed of directional and partly of irregular fibers, with the fiber types being different as well, are transported with controlled feed rate next to one another. The combination of several partial fiber flows, transported with controlled feed rate next to one another, and/or above one another, results in the particular advantage that almost any desired structure and pattern can be achieved. The additional process steps occur in a manner analogous to the initially described ones.

Figure 4:
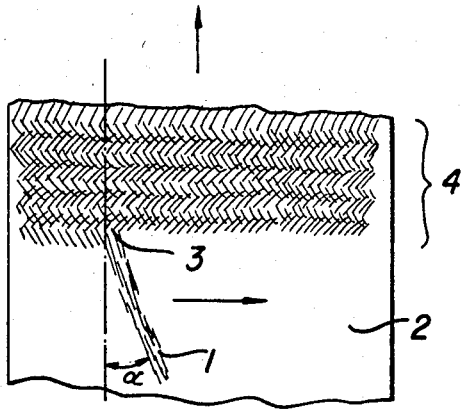
FIG. 4 shows the production of a non-woven fabric analogous to FIG. 1 on a pre-manufactured sheet.
Figure 5:
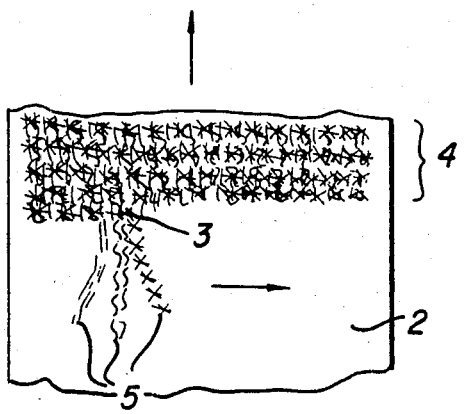
FIG. 5 shows the production of a non-woven fabric, analogous to FIG. 3 on a pre-manufactured sheet.

According to FIGS. 4 and 5, the fibers for the formation of a fiber layer 3 are placed next to one another on a supplied sheet 2, and the formed fiber layer 3 is combined simultaneously, and in the lateral border areas of the fiber layer 3, combined consecutively, with the preceding fiber layer 3, and the thus produced non-woven fabric 4 is reinforced together with the supplied sheet 2. For the production of a sheet, having more than two layers, the non-woven fabric 4 produced on a supplied sheet 2 is subsequently covered by an additional sheet in a sandwich-like fashion and reinforced, or several non-woven fabrics are simultaneously produced from several fiber flows, either individually and/or on a supplied sheet, and combined with additionally supplied sheets in arbitrary layering, and reinforced. The supplied sheets are textile sheets, such as woven fabrics, warp-knitted fabrics, knitted fabrics, and/or yarn sheets and/or foil ribbons and/or foils. When combining the fiber layers with one or several sheets, there is the advantage of virtually any desired structure and pattern of the non-woven fabric being achieved as a cross-section of the multi-layered sheet.

Figure 6:
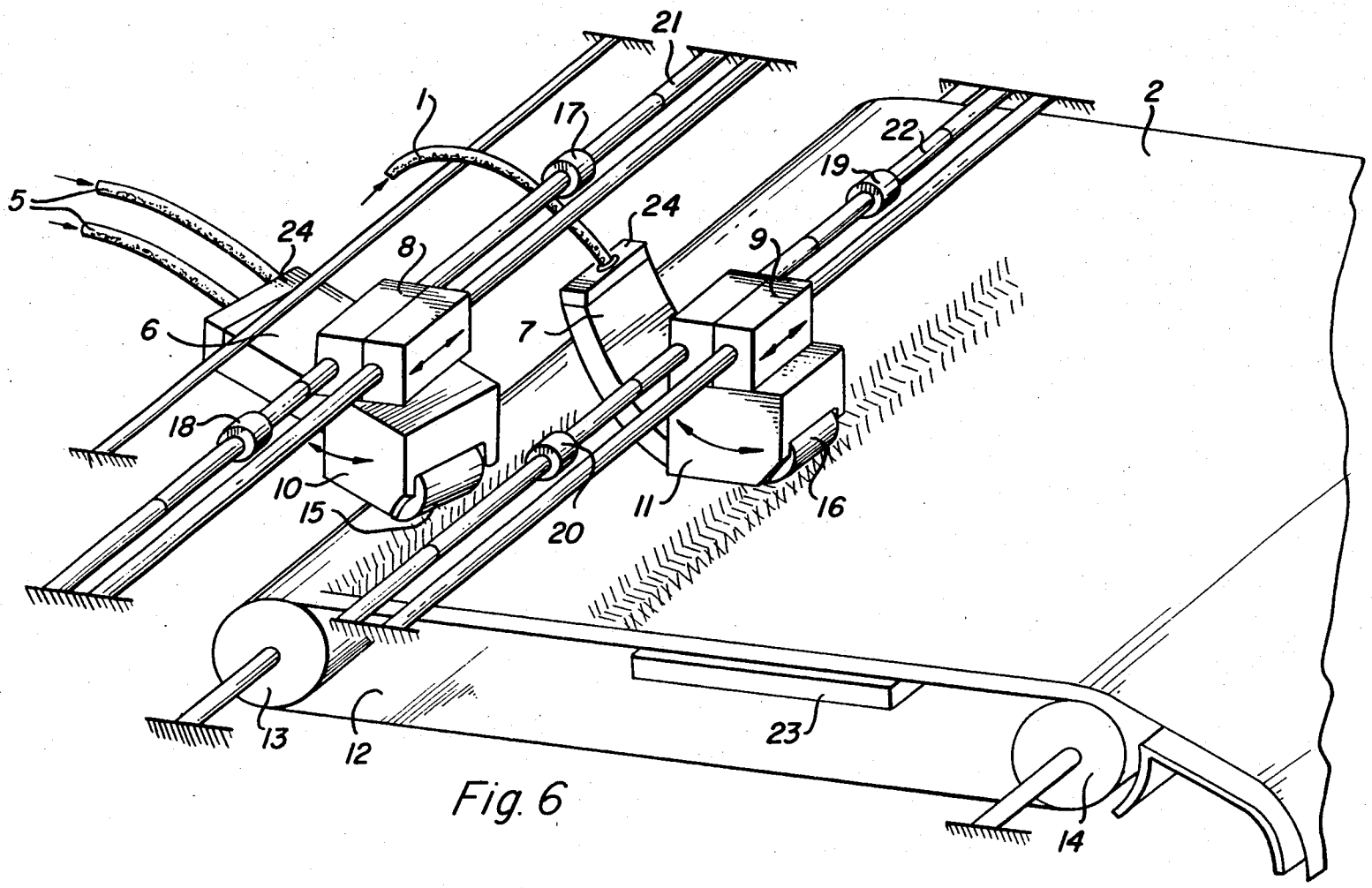
FIG. 6 is the schematic isometric depiction of the apparatus for the production of a non-woven fabric, according to FIGS. 1 to 3.

According to FIG. 6, fiber feed rate control devices 10 and 11 of a non-woven fabric transport device, consisting of a perforated conveyor belt 12 and two carrier rolls 13 and 14, are arranged relative to the fiber flow transport devices 6 and 7 at an angle which is smaller than 90° to the transport direction of the non-woven fabric to be produced, and with each connected to a traverse drive unit 8 and 9. The carrier roll 13 is formed as a suction roll. Fiber feed rate control devices 10 and 11 each have a rotation unit with a dispersing roll 15 or 16. The fiber feed rate control device 10 is arranged to the non-woven fabric transport device at an angle of between 0° and 89°, at the beginning of the non-woven material transport device. However, the fiber feed rate control device 11 is arranged at an angle of 0° to the non-woven fabric transport device, above the non-woven fabric transport device. The fiber feed rate control devices 10 and 11 and the traverse drive units 8 and 9 have variable speed motors, which have not been illustrated. The modulation of the traverse drive units 8 and 9 limited by adjustable working width position stops 17 to 20, located on the guide and drive rods 21 and 22. A suction air channel 23 is provided in the traverse level of the fiber feed rate control device 11 beneath the conveyor belt 12.

The mode of operation of the apparatus for the formation of a non-woven fabric, according to FIG. 6, is as follows:

Two partial fiber flows 5 of different types and/or color are individually supplied as fiber bands to the fiber flow transport device 6, which operates in a well-known manner, and transported into the fiber feed rate control device 10, the flow or feed rate is controlled in this device 10, i.e., preferably dispersed according to the carding principle, and deposited in the right quantity, via the effect of the dispersing roll 15, onto the conveyor belt 12, located next to one another at an angle position of between 0° and 89° to the non-woven fabric transport device, as depicted in FIG. 1. The fiber feed rate control device 10 generally moves continuously over the working width of the fiber layer to be produced, determined by the working width position stops 17 and 18. The non-woven fabric produced in this manner, not yet having its final structure and surface dimensions, arrives via the movement of the conveyor belt 12 beneath the traverse level of the fiber feed rate control device 11. The operation of this fiber feed rate control device 11 is to be understood as analogous to fiber feed rate control device 10, with the only difference being that in the case of this selected embodiment, a fiber flow 1 is inserted as fiber band in the non-woven transport device 7, with this fiber flow 1 being transported in the instantaneous setting of the fiber feed rate control device 11 of 0° to the transport direction of the non-woven fabric 2, fed onto the conveyor belt 12 at a controlled feed rate, with the fibers being deposited in this particular direction as the last fiber layer. For both fiber feed rate control devices 10 and 11, the carrier and suction roll 13 and the suction air channel 23 act in a supporting and stabilizing fashion for the fiber layers being formed. The thus produced non-woven fabric 2 is guided over the transport device to the non-woven fabric reinforcement device.

If the transport of the non-woven fabric is continuous, zig-zag-like fiber layers are produced, the overlapping degree of which depend on the relationship between the speed of the traverse and the non-woven fabric transportation. The parallel arrangement of the fiber layers requires an intermittent drive of the non-woven fabric transportation device. The fiber feed rate control devices 10 and 11 can be controlled, together with the non-woven fabric transport devices 6 and 7, via the traverse drive units 8 and 9, in their movement over the working width, so that the formation of the various fiber layer thicknesses can be achieved.

Furthermore, the fiber flow insertions 24 are exchangeable, so that with the same fiber flow transport devices 6 and 7, one or more partial fiber flows can be supplied next to one another, or above one another, in arbitrary combination.

Figure 7:
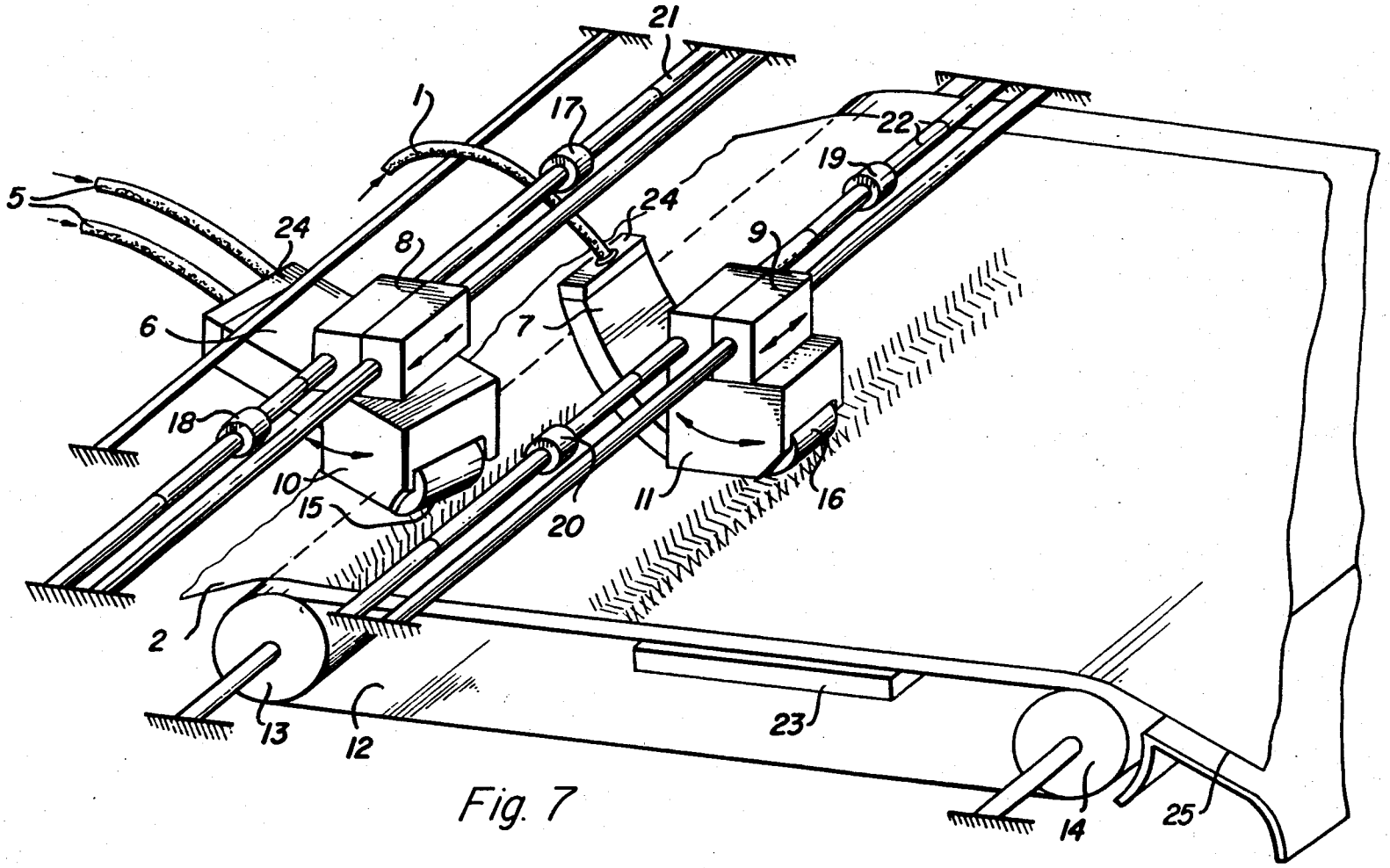
FIG. 7 is the schematic isometric depiction of the apparatus for the production of a non-woven fabric on a pre-manufactured sheet, according to FIGS. 4 and 5.

According to FIGS. 7 and 8, the pre-manufactured sheet 2 is supplied to the conveyor belt 12, on which the non-woven fabric 4 is formed and subsequently combined with the sheet 2 to form combined sheet 25. The mode of operation of the device for the production of multilayered sheets from non-woven fabrics and additional sheets, according to FIGS. 7 and 8, is analogous to the apparatus in FIG. 6.

Figure 8:
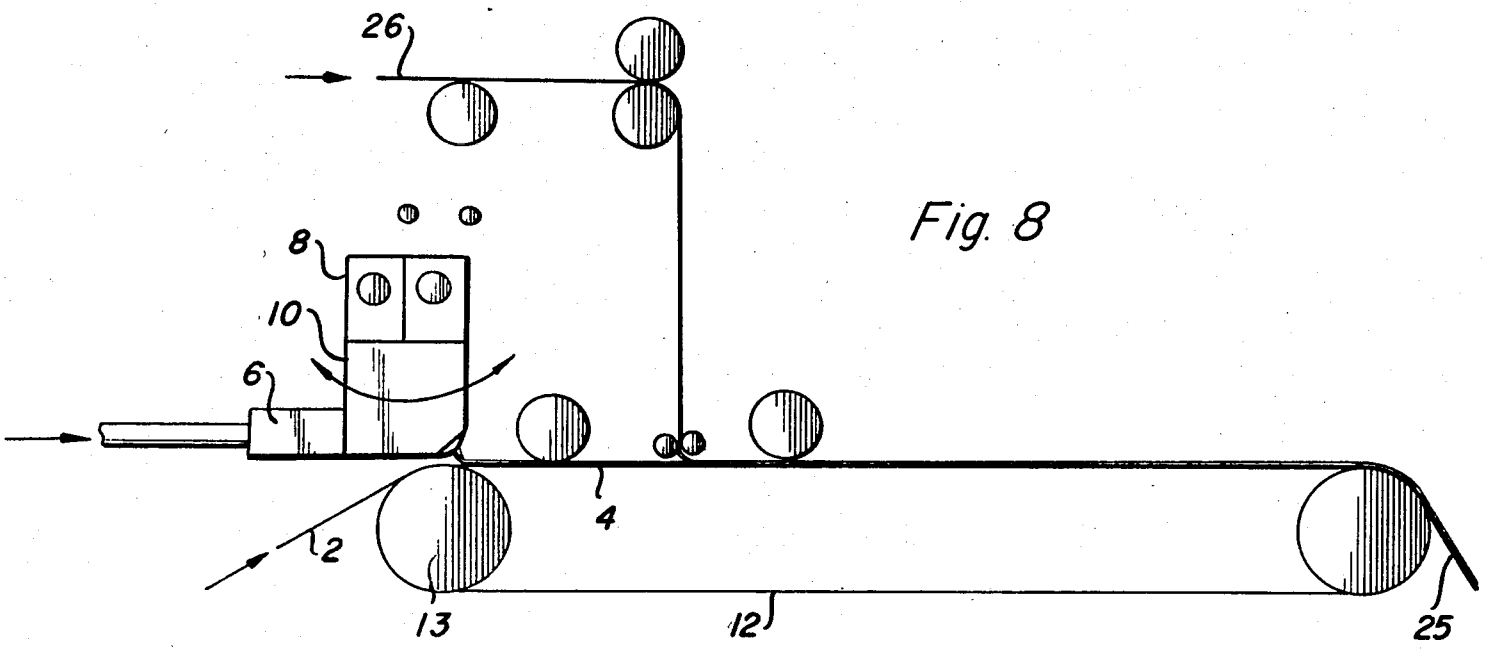
FIG. 8 is a side or lateral elevation view of the apparatus of FIG. 7.

In FIG. 8, an additional sheet 26 is supplied and placed over the formed non-woven fabric 4. Thus, there is formed a three-layer sheet 25 with a non-woven intermediate layer 4, which is transported to the reinforcement device.

It thus will be seen that there is provided a method and apparatus for production of a non-woven fabric which attains the various objects of the invention and which is well adapted for the conditions of practical use. As numerous alternatives within the scope of the present invention will occur to those skilled in the art, besides those alternatives, equivalents, variations and modifications mentioned supra, it will be understood that the invention extends fully to all such alternatives, equivalents or the like, and is to be limited only by the scope of the recitations in the appended claims, and structural and functional equivalents thereof.

We claim:

1. A method for the production of a non-woven fabric which comprises:

(a) providing a fiber material feed stream, said fiber feed stream containing a plurality of discrete individual fibers;

(b) forming a fiber flow stream from said fiber feed stream;

(c) providing a movable solid transport element, said element having a substantially planar and displaceable substantially horizontal transport surface, said transport surface being capable of supporting a non-woven fabric to be produced;

(d) placing said transport surface in linear motion, and in a generally rectilinear transport direction;

(e) passing said fiber flow stream onto said moving transport surface, and at an angle of less than 90° to the transport direction of the non-woven fabric to be produced, by transversely disposing the fibers of said fiber flow stream next to one another on said moving transport surface, so as to form a first substantially rectilinear independently oriented fiber layer on said moving transport surface, said first fiber layer being independently oriented substantially transversely to the direction of movement of said transport surface;

(f) combining said formed first fiber layer, including lateral border areas of said formed first fiber layer, with a preceding independently oriented second fiber layer, so as to reinforce the thus produced non-woven fabric; and (g) recovering a product non-woven fabric from said solid transport element.

2. The method of claim 1, in which a second fiber material feed stream is provided, said second feed stream containing a plurality of discrete individual fibers, a second fiber flow stream is formed from said second fiber feed stream, said second fiber flow stream is passed onto the moving transport surface at an angle of less than 90° to the transport direction of the non-woven fabric to be produced, and at a location spaced longitudinally away from the location at which the fibers are transversely disposed on the moving transport surface according to step (e), so that the fibers of said second fiber flow stream are transversely disposed next to one another on the moving transport surface, so as to form a third substantially rectilinear independently oriented fiber layer on the moving transport surface, said third fiber layer being independently oriented substantially transversely to the direction of movement of the transport surface, and combining the third fiber layer with at least one of the first fiber layer and the second fiber layer, so as to further reinforce the thus produced non-woven fabric.

3. The method of claim 2, in which the second fiber flow stream is passed onto the moving transport surface at a location downstream in a flow direction from the location at which the fiber flow stream is passed onto the moving transport surface according to step (e) the angle at which the second fiber flow stream is passed onto the moving transport surface is substantially 0° to the transport direction of the non-woven fabric to be produced, so that the second fiber flow stream is passed onto the moving transport surface in substantially the same direction as the direction of motion of the transport surface, and the fiber flow stream which is passed onto the moving transport surface according to step (e) is passed onto the transport surface at an angle in the range of between about 0° and 89° to the transport direction of the non-woven fabric produced according to step (g).

4. The method of claim 1, in which the fiber material feed stream of step (a) is composed of a plurality of partial fiber flow streams, each partial fiber flow stream having at least one characteristic which is different from the characteristics of the fibers in the balance of the partial fiber flow streams.

5. The method of claim 4, in which the number of partial fiber flow streams is three.

6. The method of claim 1, in which the fiber material feed stream of step (a) is composed of at least two partial fiber flow streams in the form of fiber bands of differing characteristic in at least one aspect of the respective fibers, and said two partial fiber flow streams are combined prior to step (b).

7. The method of claim 1, in which the fiber flow is controlled between steps (a) and (b), by providing an intervening monitoring of the quantity feed rate of the fiber flow, so as to provide feed rate control of the fiber flow in the fiber flow stream.

8. The method of claim 1, in which the fiber material feed stream of step (a) comprises a flow of individual fibers which are adhesively connected to one another, and the fiber flow stream of step (b) is dispersed, so as to separate the fibers from each other.

9. The method of claim 1, in which the passing of the fiber flow stream onto the moving transport surface according to step (e) includes the separating of the fibers from each other, said separation taking place by means of the rolling of the fiber flow stream of step (b) onto and about a rotating dispersing roll element, prior to step (e).

10. The method of claim 1, in which a pre-manufactured textile sheet is passed onto the moving transport surface, prior to step (e), so that the product non-woven fabric is deposited on said sheet.

11. The method of claim 10, in which a second pre-manufactured textile sheet is passed onto the product non-woven fabric, prior to the recovering of the product non-woven fabric from the solid transport element according to step (g), so that a layer of textile sheet is deposited on either side of the product non-woven fabric, to form a sandwich-like article of manufacture.

12. The method of claim 10, in which the pre-manufactured textile sheet is a supplied textile sheet selected from the group consisting of a woven fabric, a warp-knitted fabric, a knitted fabric, a yarn sheet, a foil ribbon, and a foil.

13. The method of claim 1, in which, in order to combine the formed first independently oriented fiber layer with the preceding second independently oriented fiber layer, according to step (f), one of the fiber layers is placed next to or onto the other layer.

* * * * *